US010380926B2

(12) United States Patent
Bartlett

(10) Patent No.: US 10,380,926 B2
(45) Date of Patent: Aug. 13, 2019

(54) TEAM SUPPORT DISPLAY ASSEMBLY

(71) Applicant: Bart Bartlett, Chatham (CA)

(72) Inventor: Bart Bartlett, Chatham (CA)

( * ) Notice: Subject to any disclaimer, the term of this patent is extended or adjusted under 35 U.S.C. 154(b) by 310 days.

(21) Appl. No.: 15/272,080

(22) Filed: Sep. 21, 2016

(65) Prior Publication Data

US 2018/0082616 A1 Mar. 22, 2018

(51) Int. Cl.
*G09F 23/00* (2006.01)
*A44B 15/00* (2006.01)

(52) U.S. Cl.
CPC ..... *G09F 23/00* (2013.01); *A44B 15/005* (2013.01)

(58) Field of Classification Search
CPC ..... G09F 23/14; A44B 15/00
See application file for complete search history.

(56) References Cited

U.S. PATENT DOCUMENTS

| | | | | |
|---|---|---|---|---|
| 1,423,147 | A * | 7/1922 | Perry | A44B 15/00 40/634 |
| 4,369,215 | A | 1/1983 | Offen et al. | |
| 5,615,454 | A | 4/1997 | Contarino | |
| 5,926,848 | A | 7/1999 | Bartholomae | |
| 6,334,239 | B1 | 1/2002 | Kraut | |
| 6,364,237 | B1 * | 4/2002 | Kagel | A45F 5/004 242/371 |
| 6,675,611 | B2 | 1/2004 | Hunter | |
| 7,165,272 | B2 | 1/2007 | Hudson et al. | |
| D561,938 | S | 2/2008 | Madden | |
| 2002/0095952 | A1 | 7/2002 | Kelly | |

* cited by examiner

*Primary Examiner* — Adam Krupicka

(57) ABSTRACT

A team support display assembly includes a panel that has a front side, a back side and a perimeter edge. A plurality of perimeter wall sections is attached to the perimeter edge and extends rearward of the panel. The perimeter wall sections are spaced from each other such that a plurality of gaps is defined between the perimeter wall sections. At least two of the perimeter wall sections have one of a plurality of couplers mounted thereon. Each of the couplers releasably engages a key ring such that the panel is mounted on the key ring. The gaps expose portions of the key ring. A band is extended around and releasably attached to the key ring. The band is positioned in one of the gaps and a clip is attached to the band.

4 Claims, 5 Drawing Sheets

TEAM SUPPORT DISPLAY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to team display devices and more particularly pertains to a new team display device for attachment to a key ring to demonstrate support for a particular sports team, school or the like.

BRIEF SUMMARY OF THE INVENTION

An embodiment of the disclosure meets the needs presented above by generally comprising a panel that has a front side, a back side and a perimeter edge. A plurality of perimeter wall sections is attached to the perimeter edge and extends rearward of the panel. The perimeter wall sections are spaced from each other such that a plurality of gaps is defined between the perimeter wall sections. At least two of the perimeter wall sections has one of a plurality of couplers mounted thereon. Each of the couplers is configured to releasably engage a key ring such that the panel is mounted on the key ring. The gaps expose portions of the key ring when the panel is mounted on the key ring. A band is configured to be extended around and releasably attached to the key ring. The band is positioned in one of the gaps and a clip is attached to the band.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
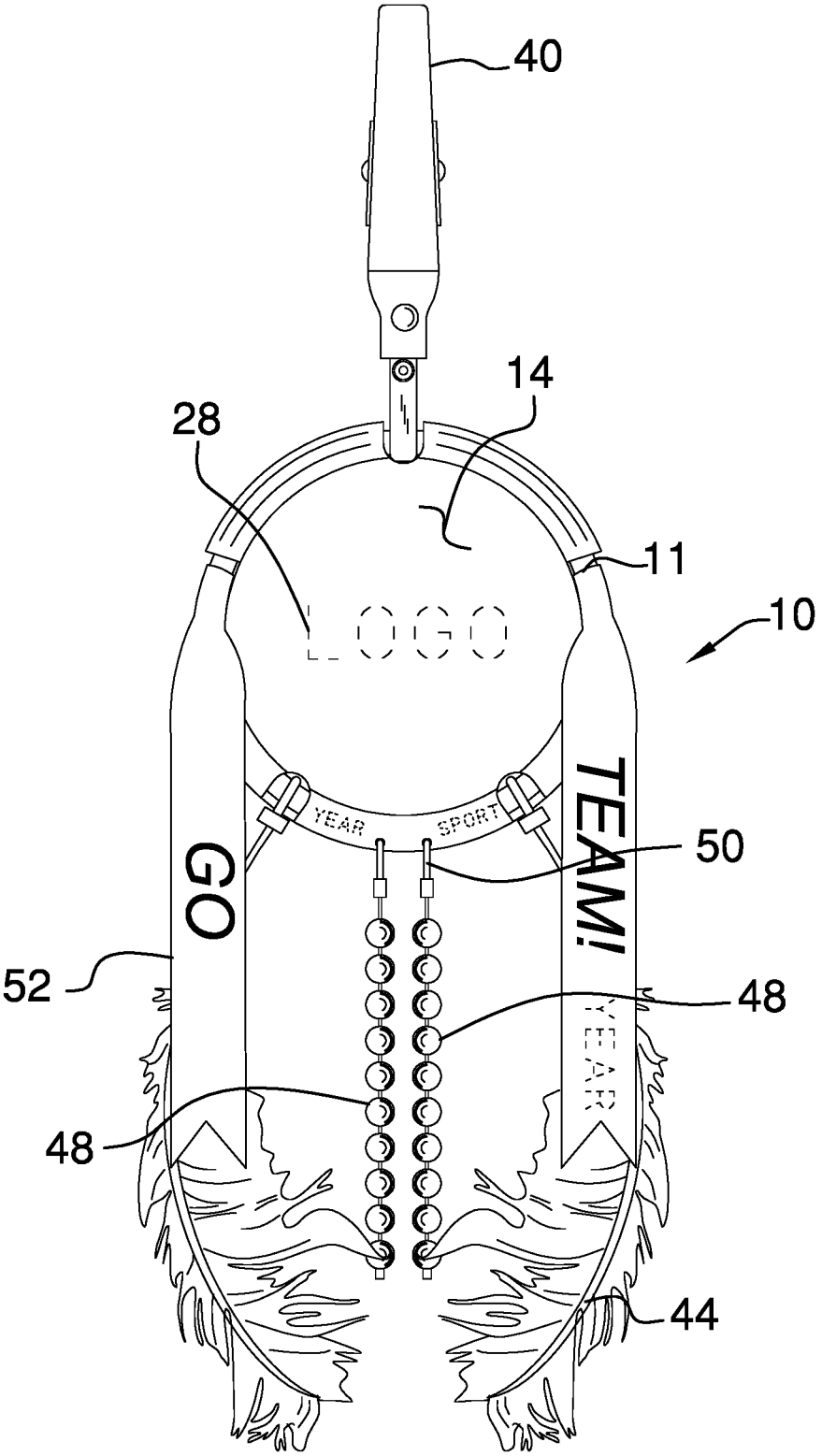
FIG. 1 is a front view of a team support display assembly according to an embodiment of the disclosure.
Figure 2:
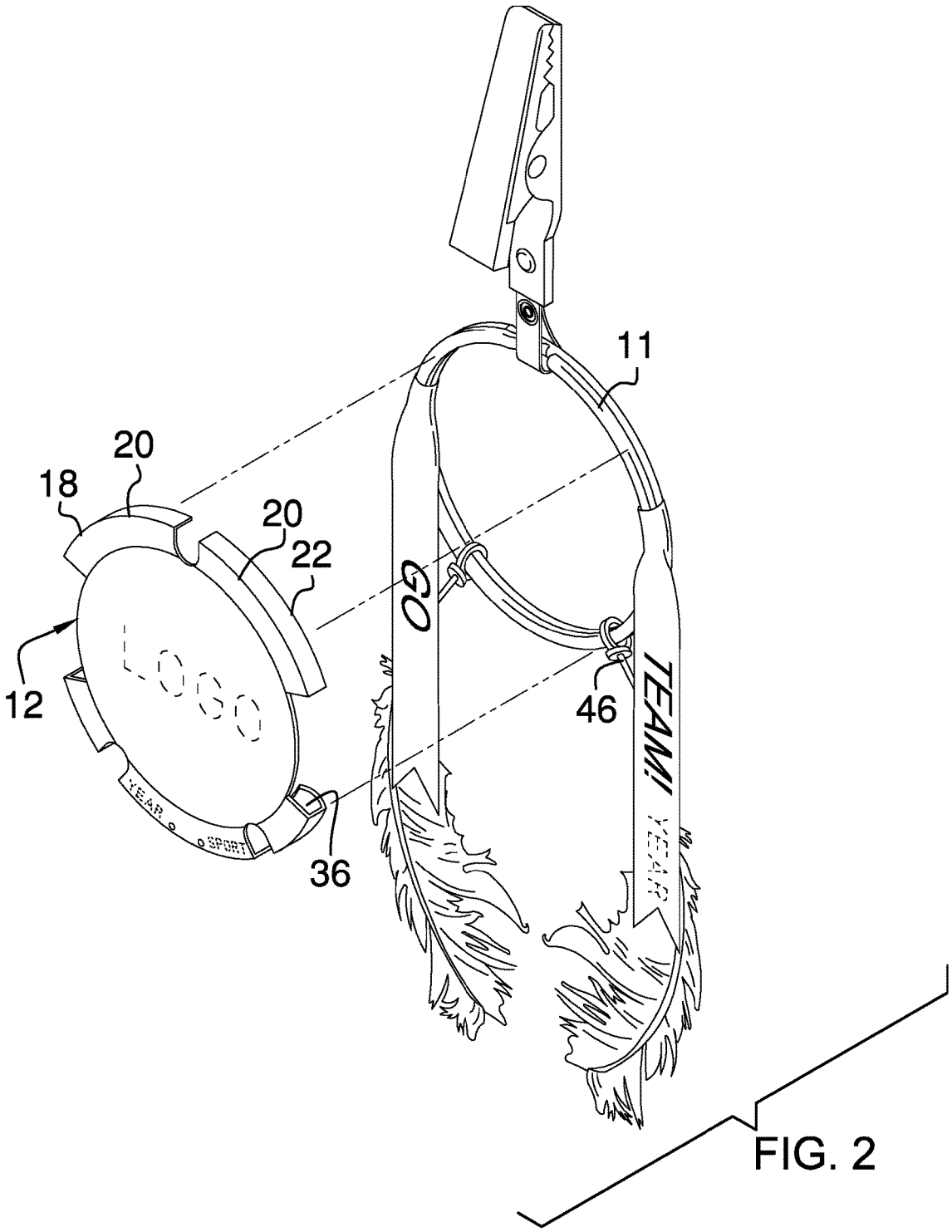
FIG. 2 is a perspective view of an embodiment of the disclosure.
Figure 3:
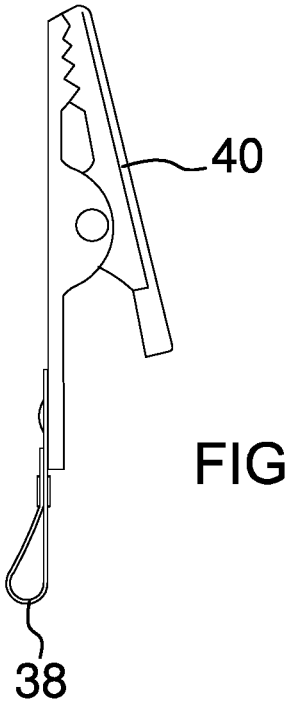
FIG. 3 is a side view of a clip of an embodiment of the disclosure.
Figure 4:
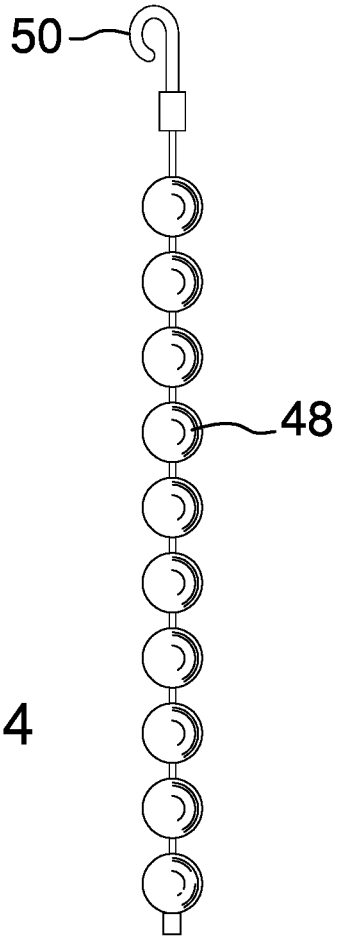
FIG. 4 is a side view of beads of an embodiment of the disclosure.
Figure 5:
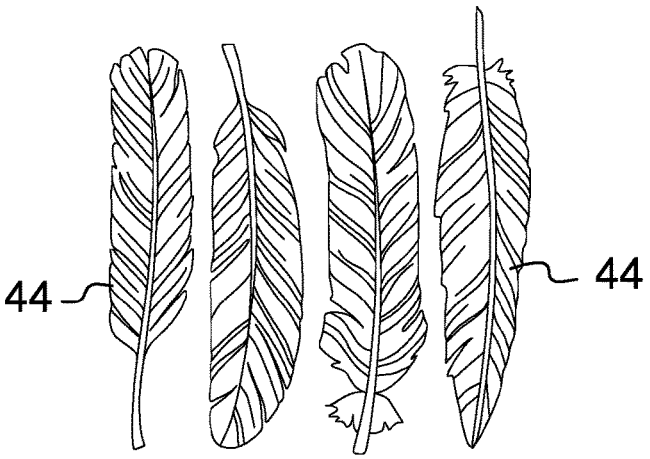
FIG. 5 is a front view of feathers an embodiment of the disclosure.
Figure 6:
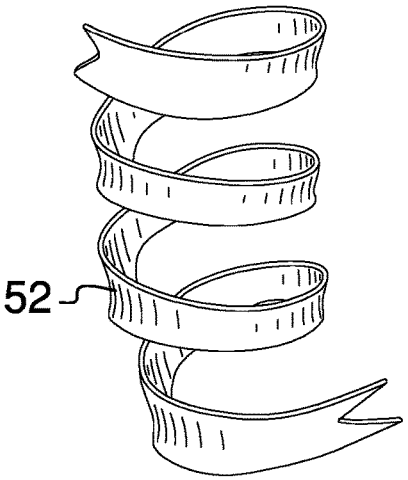
FIG. 6 is a front perspective view of ribbons of an embodiment of the disclosure.
Figure 7:
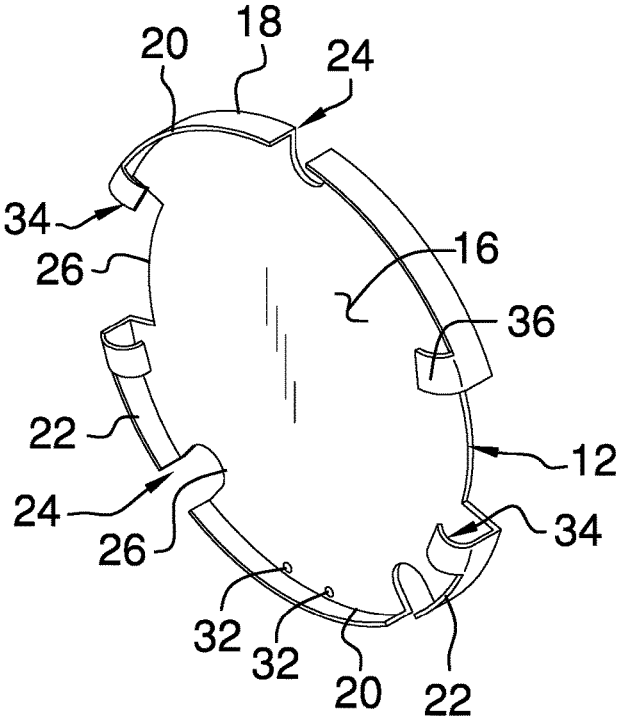
FIG. 7 is a rear perspective view of an embodiment of the disclosure.
Figure 8:
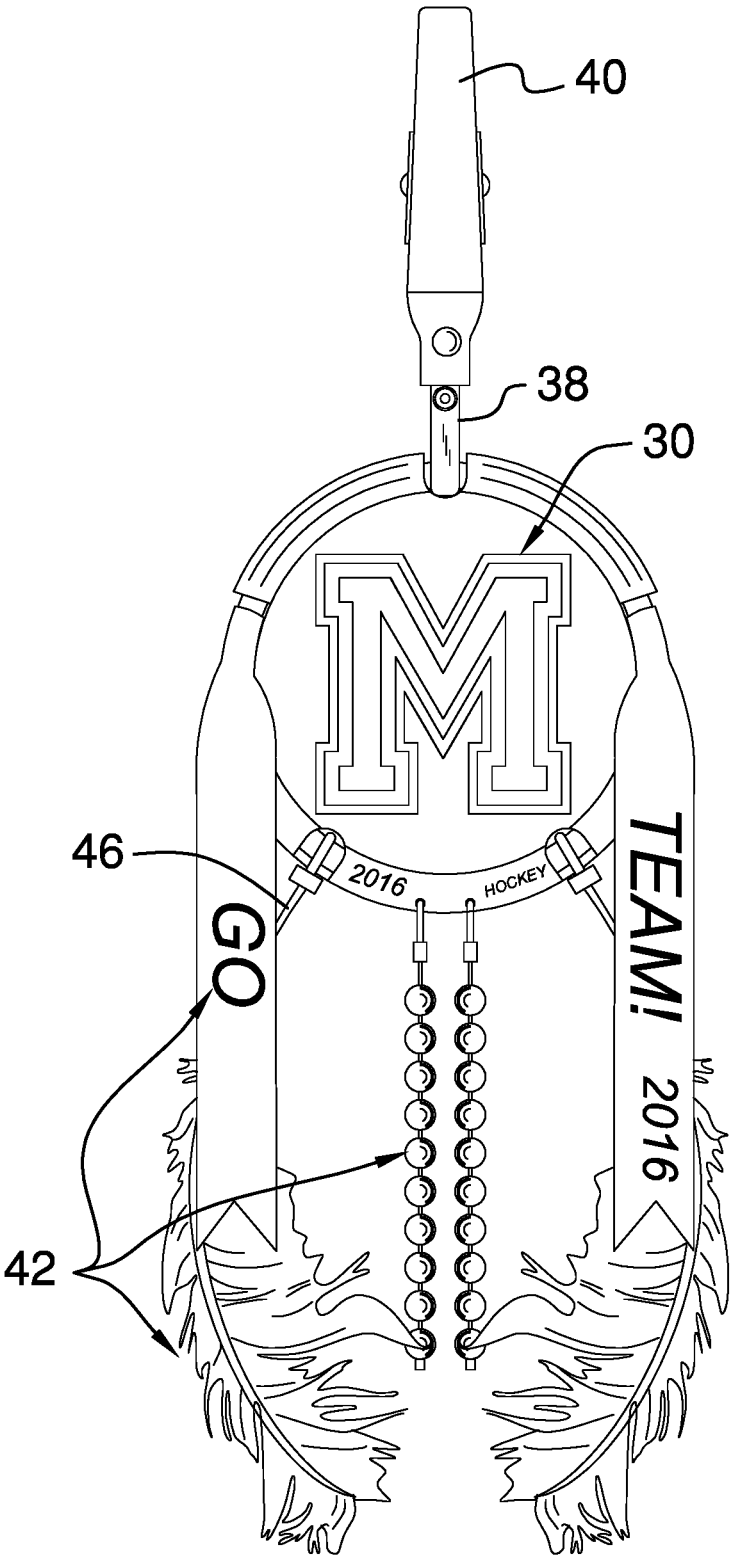
FIG. 8 is a front view of an embodiment of the disclosure.

With reference now to the drawings, and in particular to FIGS. 1 through 8 thereof, a new team display device embodying the principles and concepts of an embodiment of the disclosure and generally designated by the reference numeral 10 will be described.

As best illustrated in FIGS. 1 through 8, the team support display assembly 10 generally comprises a panel 12 that has a front side 14, a back side 16 and a perimeter edge 18. A plurality of perimeter wall sections 20 is attached to the perimeter edge 22 and extends rearward of the panel 12. The perimeter wall sections 20 are spaced from each other such that a plurality of gaps 24 is defined between the perimeter wall sections 20. The perimeter edge 22 has a plurality of notches 26 therein each positioned in one of the gaps 24 such that each of the gaps 24 includes one of the notches 26. The front side 14 may include indicia 28 such as a logo 30 or other markers indicating support for a team, school, organization, person or the like. The panel 12 may have one or more apertures 32 therein positioned adjacent to the perimeter edge 22.

A plurality of couplers 34 is provided. At least two of the perimeter wall sections 20 have one of the couplers mounted thereon. Each of the couplers 34 is configured to releasably engage a key ring 11 such that the panel 12 is mounted on the key ring 11. The key ring 11 is conventional and may be used for holding keys and other such items. Each of the couplers 34 comprises a catch 36 extending inwardly from an associated one of the perimeter wall sections 20 and extending over the back side 16. The catches 36 are arcuate and extend toward the back side 16 so that the key ring 11 can be positioned between the catches 36 and the panel 12. Each of the couplers 34 is resiliently bendable and may form a unitary structure and may be formed of a plastic, metal or elastomeric material. The gaps 24 expose portions of the key ring 11 when the panel 12 is mounted on the key ring 11.

A band 38 is configured to be extended around and releasably attached to the key ring 11. The band 38 is positioned in one of the gaps 24 so that it may freely rotate with respect to the key ring 11. A clip 40 is attached to the band 38. The clip 40 may be a conventional alligator clip for attachment to clothing, hair or other objects. A plurality of decorative elements 42 is configured to be mounted to key ring 11. Each of the decorative elements 42 is positioned in one of the gaps 24. The decorative elements 42 may include feathers 44 attached to tethers 46, such as with glue or mechanical fasteners, that are mounted on the key ring 11 and positioned in one of the gaps 24. Alternatively or additionally, beads 48, attached to tethers 46, may also be placed on the key ring 11 or the beads 48 may be attached to a clip or hook 50 that is extendable through one of the apertures 32. Ribbons 52 may be mounted as well to the key ring 11 by extending a portion of the ribbons 52 between windings of the key ring 11. Each of the decorative elements 42 may be replaced or changed for other decorative elements 42 such that assembly 10 may be color coordinated to the team being sponsored.

In use, the assembly 12 is used with a key ring 11 to decorate a key ring 11 with the colors and logo of a favorite team, in particular, though it may be used with any person, organization, or the like that a person would like to show support for. The gaps 24 and notches 26 retain the decorative elements 42 and clip 40 in place so that they do not move around the key ring 11 and thereby provide adequate exposure of the logo 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A display assembly configured to be removably mounted to a key ring, said assembly comprising:

a panel having a front side, a back side and a perimeter edge, a plurality of perimeter wall sections being attached to said perimeter edge and extending rearward of said panel, said perimeter wall sections being spaced from each other such that a plurality of gaps are defined between said perimeter wall sections;

a plurality of couplers, at least two of said perimeter wall sections having one of said couplers mounted thereon, each of said couplers being configured to releasably engage a key ring such that said panel is mounted on the key ring, wherein said gaps expose portions of the key ring when said panel is mounted on the key ring;

a band being configured to be extended around and releasably attached to the key ring, said band being positioned in one of said gaps, a clip being attached to said band; and each of said couplers comprising a catch extending inwardly from an associated one of said perimeter wall sections and over said back side.

2. The display assembly configured to be removably mounted to a key ring according to claim 1, wherein each said catch is arcuate and extends toward said back side.

3. The display assembly configured to be removably mounted to a key ring according to claim 2, wherein each of said couplers is resiliently bendable.

4. A display assembly configured to be removably mounted to a key ring, said assembly comprising:

a panel having a front side, a back side and a perimeter edge, a plurality of perimeter wall sections being attached to said perimeter edge and extending rearward of said panel, said perimeter wall sections being spaced from each other such that a plurality of gaps are defined between said perimeter wall sections, said perimeter edge having a plurality of notches therein, each of said notches being positioned in one of said gaps such that each of said gaps includes one of said notches;

a plurality of couplers, at least two of said perimeter wall sections having one of said couplers mounted thereon, each of said couplers being configured to releasably engage a key ring such that said panel is mounted on the key ring, each of said couplers comprising a catch extending inwardly from an associated one of said perimeter wall sections and over said back side, each said catch being arcuate and extending toward said back side, each of said couplers being resiliently bendable;

wherein said gaps expose portions of the key ring when said panel is mounted on the key ring;

a band being configured to be extended around and releasably attached to the key ring, said band being positioned in one of said gaps, a clip being attached to said band; and a plurality of decorative elements being configured to be mounted to key ring, each of said decorative elements being positioned in one of said gaps.

* * * * *